US006287066B1

(12) United States Patent
Heinz et al.

(10) Patent No.: US 6,287,066 B1
(45) Date of Patent: Sep. 11, 2001

(54) DEVICE FOR SEPARATING ITEMS OF LAUNDRY

(75) Inventors: Engelbert Heinz, Vlotho; Friedhelm Mehrhoff, Hille; Andreas Olivieri, Porta Westfalica, all of (DE)

(73) Assignee: Herbert Kannegiesser GmbH & Co., Vlotho (DE)

( * ) Notice: Subject to any disclaimer, the term of this patent is extended or adjusted under 35 U.S.C. 154(b) by 0 days.

(21) Appl. No.: 09/570,285

(22) Filed: May 12, 2000

Related U.S. Application Data

(62) Division of application No. 09/036,296, filed on Mar. 6, 1998, now Pat. No. 6,089,810.

(51) Int. Cl.[7] ..... E04G 21/14
(52) U.S. Cl. ..... 414/13; 198/455; 198/468.2
(58) Field of Search ..... 198/455, 468.2; 414/3

(56) References Cited

U.S. PATENT DOCUMENTS

| | | | | |
|---|---|---|---|---|
| 2,633,971 | | 4/1953 | Albertoli et al. . | |
| 3,092,271 | | 6/1963 | Beaudry et al. . | |
| 3,696,942 | * | 10/1972 | Kitchener et al. | 414/13 |
| 4,578,013 | | 3/1986 | Barillec et al. . | |
| 4,739,874 | | 4/1988 | Akutagawa . | |
| 4,943,198 | | 7/1990 | McCabe . | |
| 6,082,946 | * | 7/2000 | Jensen | 414/13 |

FOREIGN PATENT DOCUMENTS

| | | |
|---|---|---|
| 3119661 A1 | 12/1982 | (DE) . |
| 3819167 A | 6/1988 | (DE) . |
| 4330911 A1 | 3/1995 | (DE) . |
| 4345313 A1 | 10/1995 | (DE) . |
| 0272368 A1 | 6/1988 | (EP) . |
| 2269473 | 11/1975 | (FR) . |
| 2377344 | 8/1978 | (FR) . |
| 07231988 A | 9/1995 | (JP) . |
| 466705 | 3/1992 | (SE) . |
| WO 97/13914 A1 | 4/1997 | (WO) . |

* cited by examiner

*Primary Examiner*—Christopher P. Ellis
*Assistant Examiner*—Joe Dillon, Jr.
(74) *Attorney, Agent, or Firm*—Technoprop Colton LLC

(57) ABSTRACT

According to the invention, the items of laundry (11) are grasped successively by a gripper (23), are lifted up and taken over by a transfer means (24) which transports the respective item of laundry (11) through a gap (29). The gap (29) of the transfer means (24) ensures that only individual items of laundry (11) can be transported on further by the transfer means (24) and a force which is required for completely pulling out the respective item of laundry (11) from the pile of laundry (10) can be exerted on the item of laundry (11). As a result, reliable separating of items of laundry (11) from a pile of laundry (10) is ensured.

5 Claims, 8 Drawing Sheets

20
19
21
18
24
26
30
22
31
32
17
25
28
11
11
10
23
10
33
12
34
27
13
15
16
14

19
20
21
18
24
23
31
26
32
28
11
11
25
11
10
30
27
10
17
12
33
34
22
15
16
13
14

20
19
21
18
24
23
30
26
32
29
27
31
11
25
11
11
10
17
34
33
28
22
10
12
15
16
14
13

DEVICE FOR SEPARATING ITEMS OF LAUNDRY

STATEMENT OF RELATED APPLICATIONS

This application is a divisional of Application No. 09/036,296, filed on Mar. 6, 1998, now U.S. Pat. No. 6,089,810.

BACKGROUND OF THE INVENTION

1. Technical Field

The invention relates to devices for separating and/or grasping items of laundry having a gripping device for grasping preferably individual items of laundry from a pile of laundry or the like, and having a transfer means which takes over the item of laundry grasped by the gripping means and transports it on further having a gripping device for grasping preferably individual items of laundry from a pile of laundry or the like, and having a transfer means which takes over the item of laundry grasped by the gripping means and transports in on further and/or a stockpiling means for the items of laundry.

2. Prior Art

Washed items of laundry usually leave a washing machine in a pile. Before the items of laundry coming out of a washing machine in this manner pass through further laundry treatments in the laundry sector, for example, are put through a mangle, the (still damp) items of laundry leaving the washing machine in a pile have to be separated. The aim is to mechanize this procedure of separating the items of laundry or other textile articles.

Devices which grasp individual items of laundry from the pile of laundry are already known. However, these known devices have been shown to frequently make mistakes. Also, occasionally several items of laundry are grasped at the same time. As a result, it is not possible for the items of laundry to be separated reliably. In consequence, the known devices of this type are subject to losses in efficiency.

BRIEF SUMMARY OF THE INVENTION

Taking this as the starting point, the invention is based on the object of providing a method and a device for reliably and efficiently separating and/or grasping items of laundry.

A method for achieving this object is disclosed herein. The fact that the transfer means transports the respective item of laundry on through a gap means that even heavy items of laundry can reliably be pulled out of the pile of laundry. Above all, this is the case even if other items of laundry are wrapped around the item of laundry to be separated in each case, because the transporting of the item of laundry through the gap enables relatively large tensile forces to be imparted to the item of laundry. The gap furthermore ensures that only individual items of laundry are taken over by the transfer means and transported on further.

It is furthermore proposed to change the width of the gap during the transfer procedure. The grasped items of laundry can be moved through into the initially open gap by means of a gripping member. During a subsequent reduction in the width of the gap, the item of laundry is coupled up to one part of the transfer means, which part bounds the gap on one side. This part is preferably designed as a revolving conveyor which acts on one side of the item of laundry. Should several items of laundry have been grasped, only the lowermost item of laundry comes into contact with that part of the transfer means which serves for the coupling up and this means that the other item of laundry drops, if the gripping member for lifting up at least some of the items of laundry opens. After only a single item of laundry has been coupled up in this manner to one part of the transfer means, the gap is closed further until parts of the transfer means which bound the gap on both sides bear against opposite sides of the item of laundry. Using the necessary force, the transfer means is then able to completely pull the separated item of laundry out of the pile of laundry.

A device for achieving the object on which the invention comprises a gripping device for grasping preferably individual items of laundry from a pile of laundry or the like, and having a transfer means which takes over the item of laundry grasped by the gripping means and transports it on further, wherein the transfer means is formed from a conveyor and a pressure member that cooperates with the conveyor, and the transfer means has a gap through which the respective item of laundry can be transported. The transfer means, which is provided with a gap which is preferably variable in size, ensures that individual items of laundry are transferred and that they are reliably transported on further. The gap of the transfer means permits a frictional resistance which meets the requirements and which makes it possible reliably to separate the items of laundry, even under difficult conditions, and to pull them out completely from the pile of laundry.

According to a preferred development of the invention, the transfer means essentially comprises a conveyor and a pressure member which co-operates therewith. The gap is then formed between, in particular, one part of the conveyor and the pressure member. Conveyor and pressure member thus bound opposite sides of the gap. The respective item of laundry can be moved through between the conveyor and the pressure member. The conveyor, which is driven in a revolving manner, pulls the respective item of laundry through the gap which is formed in this manner. If the need arises, it is also possible for a pressure roller, which forms the pressure member, to be driven preferably synchronously with respect to the conveyor. It is also conceivable, however, for the pressure roller to be designed such that it can rotate freely, with the result that it is moved by the item of laundry pulled through the gap.

In a preferred embodiment of the invention the width of the gap can be varied. For this purpose, the distance between the conveyor and the pressure roller can be changed by an appropriate movement of the conveyor or of the pressure roller. If appropriate, it is even possible for both of them to be moveable. Preferably, however, only the conveyor is pivoted in order to change the width of the gap. By this means, it is initially only the conveyor which is coupled up to an item of laundry. While the gap is still so large that the pressure roller has not yet made any contact with the item of laundry, a further separating procedure takes place if several items of laundry should have been grasped during the preceding gripping procedure, because only the lower item of laundry (which is bearing against the pivotal conveyor) is coupled up to the conveyor and the items of laundry lying above the lower one slip off from the (lower) item of laundry coupled up to the conveyor.

A further, independent achievement of the object, which can also be a further development of the above described device, comprises a gripping device for grasping the items of laundry, and having a stockpiling means for the items of laundry, wherein the stockpiling means has at least one temporary storage facility. In accordance therewith, the stockpiling means, from which the items of laundry are removed individually, is assigned at least one temporary storage facility. The temporary storage facility can be loaded with items of laundry while items of laundry are still being removed from the stockpiling means. The items of laundry can be supplied rapidly to the stockpiling means from the temporary storage facility without there having to be an interruption for this purpose in the procedure for removing items of laundry in a separated fashion from the stockpiling means. In this manner, the stockpiling means can be loaded with new items of laundry in a simple and also time-saving manner. The stockpiling means can be supplied with items of laundry from the temporary storage facility when the last item of laundry has been removed from the stockpiling means. However, it is conceivable for the stockpiling means to be supplied with new items of laundry from the temporary storage facility if there are still items of laundry in the stockpiling means. This means that special checking measures are not needed to ensure that there is always a sufficient number of items of laundry in the stockpiling means.

A further device for independently achieving the object mentioned at the beginning, or else for developing the above described devices, has the features of claim 17. Changing the shape of the stockpiling means enables individual items of laundry to be removed from the stockpiling means, even if there is still a relatively small number of items of laundry therein. In particular, the shape of the stockpiling means is changed, for this purpose, such that it obtains a relatively markedly funnel-shaped design.

The stockpiling means preferably has at least one flexible wall. This enables the shape of the stockpiling means to be changed simply and effectively by the stockpiling means being moved up and down. Whereas in a lowered starting position part of the stockpiling means rests on a support, it has an at least partially flat base with a great receiving capacity for many items of laundry. In contrast, if the stockpiling means is lifted up, by its base being moved away from the support, the stockpiling means, which is of flexible design, obtains a funnel-shaped base which leads to the items of laundry automatically passing into the centre of the stockpiling means and, as a result, even the last items of laundry can be automatically grasped and separated.

According to a further, optionally independent proposal of the invention, it is envisaged periodically to move the stockpiling means at least intermittently, or to throw it into oscillations, in particular to agitate or shake it. As a result of this too, the items of laundry, in particular the last items of laundry, pass into the centre of the stockpiling means and from there can be individually grasped and removed reliably. Agitating, or periodically moving the stockpiling means in some other way, in conjunction with a stockpiling means which can be varied in shape, is particularly effective. A flexible stockpiling means can thereby be brought, counter to the resistance of the items of laundry situated therein, into a changed shape, in particular a shape which tapers in a markedly funnel-like manner towards the centre and downwards.

The agitating or periodic movement of the stockpiling means taking place in some other manner can be achieved by lifting means of the stockpiling means, which lifting means are operated jerkily or intermittently, or by separate oscillation generators, for example unbalanced drives, and/or pressure-actuated members executing linear movements. The pressure-actuated members can be assigned to the stockpiling means in such a manner that their movements take place in directions which deviate from the movement path of the gripping device, preferably run approximately at a right angle thereto. It is also conceivable to combine unbalanced drives or other oscillation generators with movement means which are driven jerkily and/or periodically.

BRIEF DESCRIPTION OF THE DRAWINGS

Preferred exemplary embodiments of the invention are explained in more detail below with reference to the drawing, in which.

DETAILED DESCRIPTION OF THE PREFERRED EMBODIMENTS

The devices shown are used, in particular, automatically to remove individual items of laundry 11 from a pile of laundry coming, for example, from a washing machine. The items of laundry 11 separated in this manner are subsequently supplied to a further processing laundry procedure, in particular are fed into a mangle.

Figure 1:
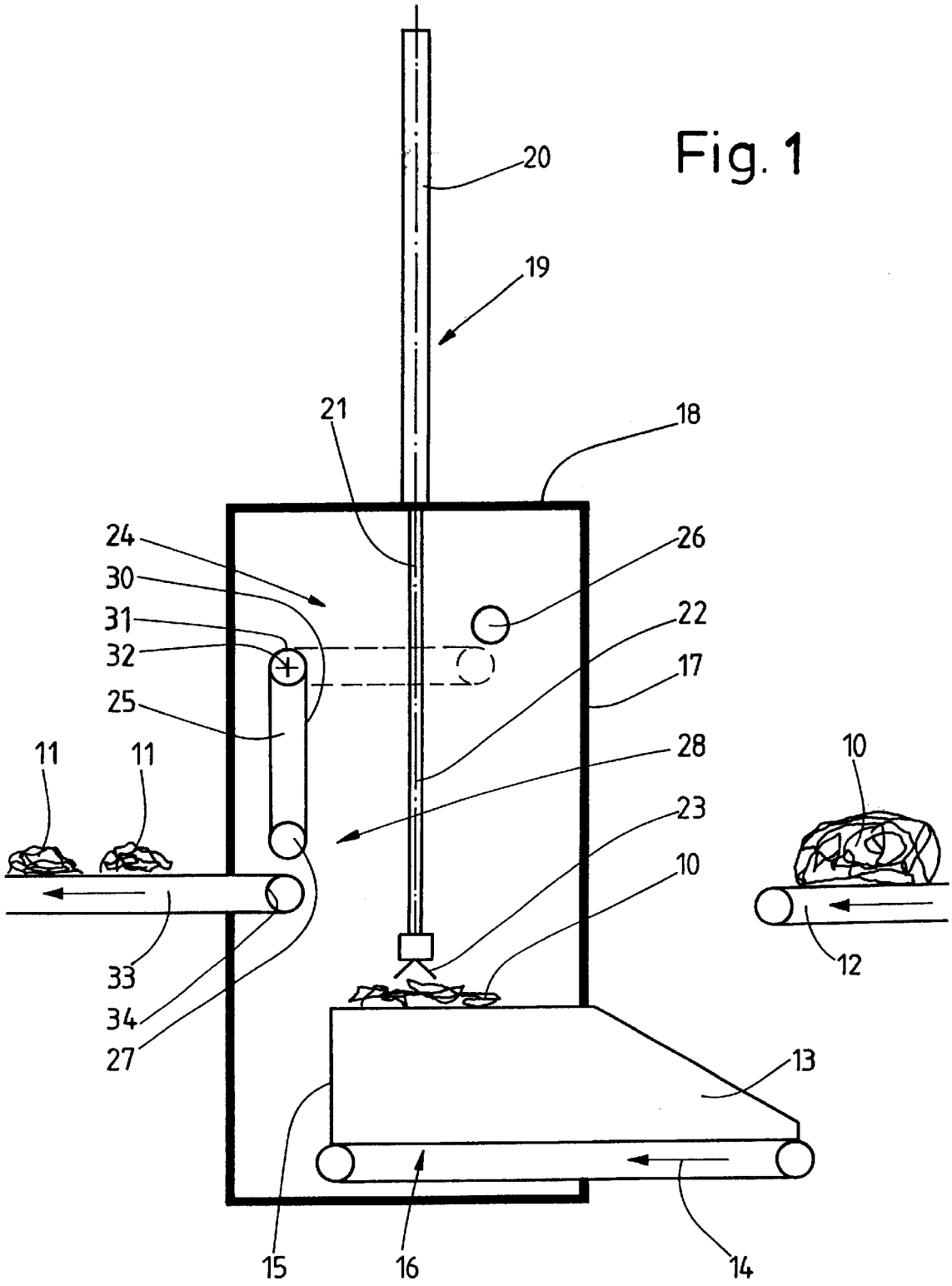
FIG. 1 shows a schematic side view of a device shortly before an item of laundry to be separated is grasped.
Figure 2:
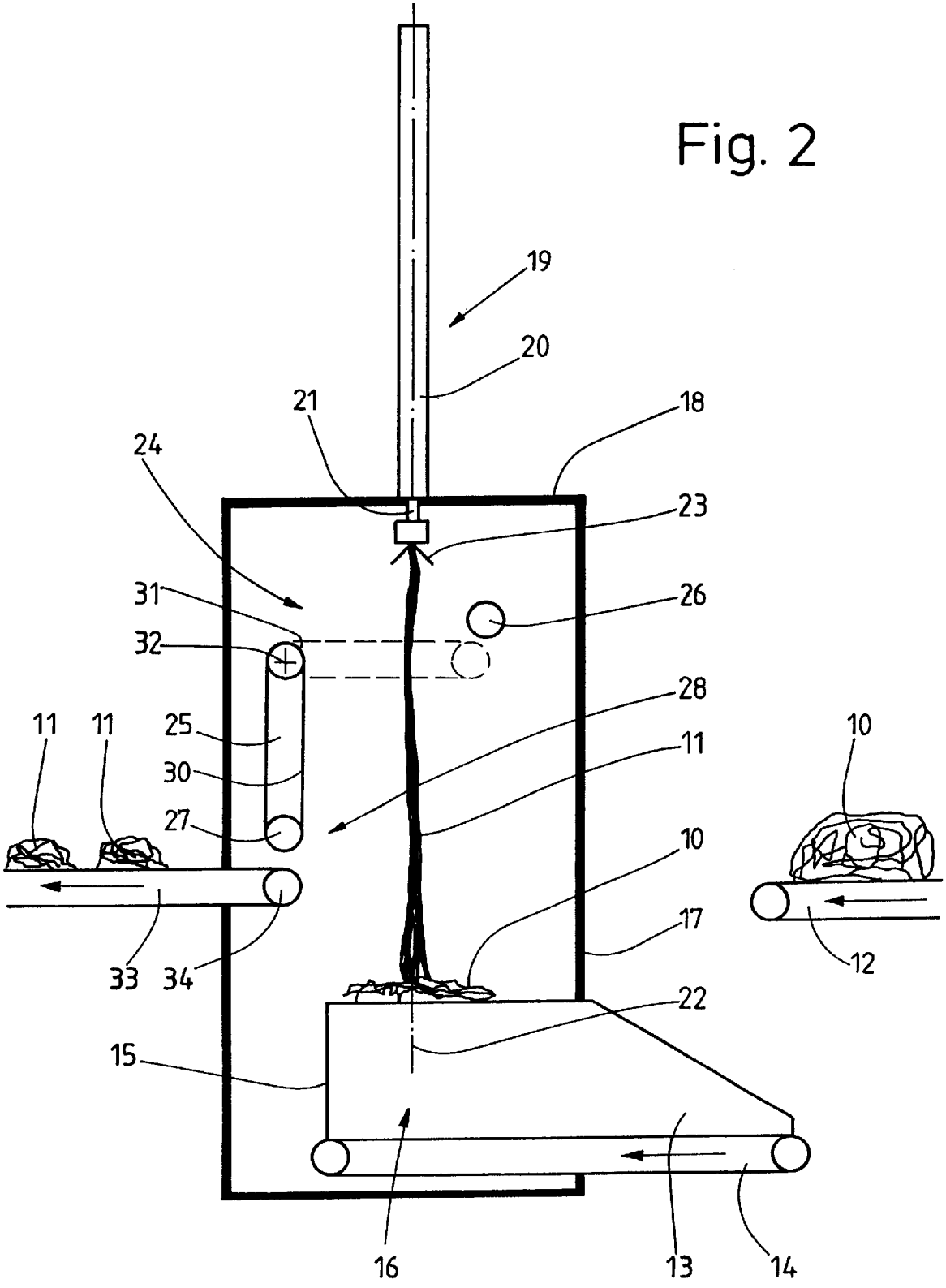
FIG. 2 shows the device in a view according to FIG. 1, after the item of laundry has been grasped and partially pulled out of a pile of laundry.
Figure 3:
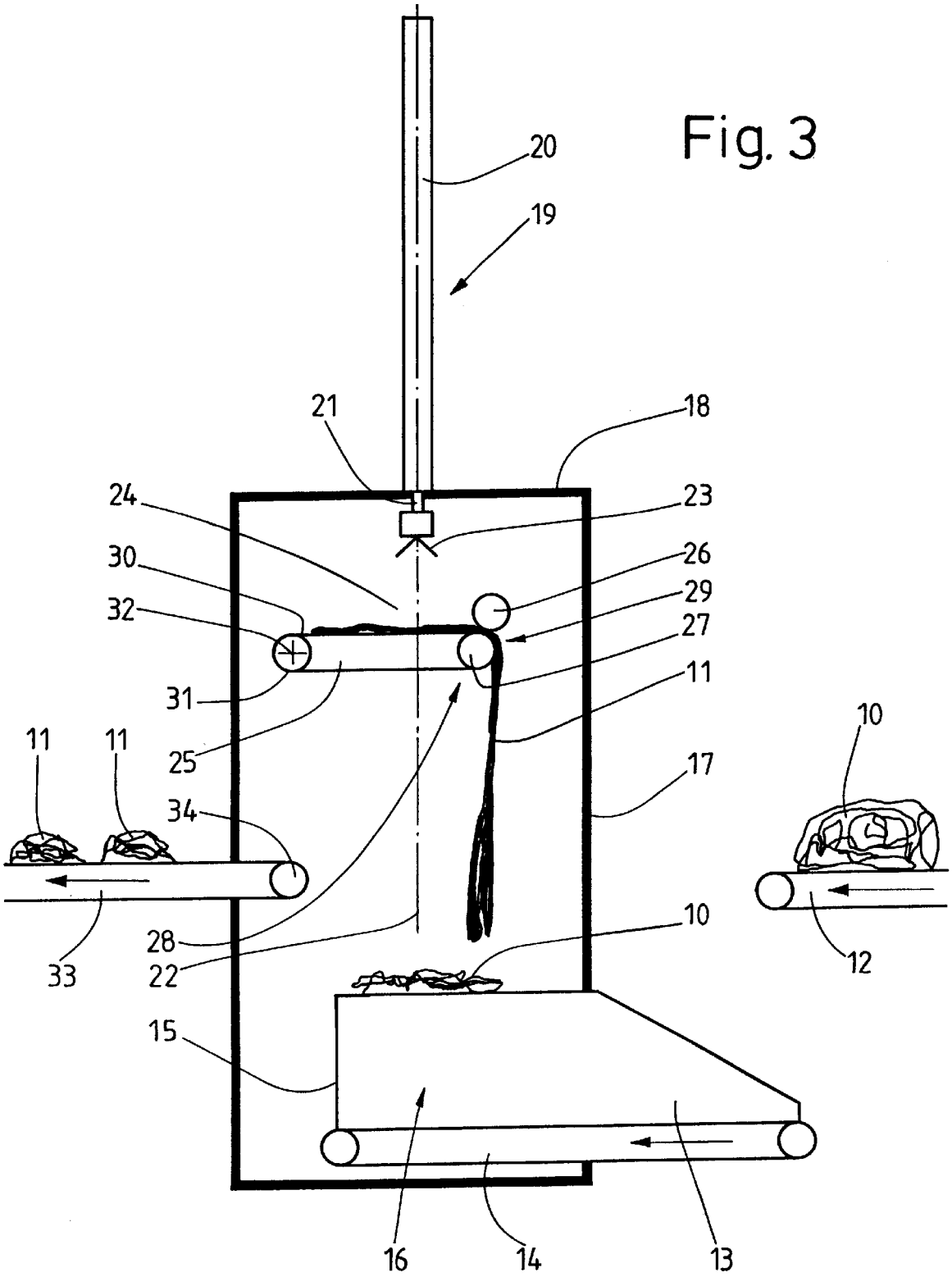
FIG. 3 shows the device of FIGS. 1 and 2 with a separated item of laundry.

The pile of laundry 10, which is composed of a multiplicity of still damp items of laundry 11, is supplied, in the case of the exemplary embodiment of FIGS. 1 to 3, to the device via a feed conveyor 12. From the feed conveyor 12 the pile of laundry 10 passes into the region of a funnel 13. In the exemplary embodiment shown, there is arranged below the funnel 13 a conveyor 14 which transports the pile of laundry 10 to one end of the funnel 13 (on the left in the figures), against a transversely directed end wall 15 of said funnel. As a result of this, the pile of laundry 10 obtains a defined position which facilitates the grasping of items of laundry 11 from the pile of laundry 10.

The end region 16 of the funnel 13 and of the conveyor 14 is assigned a supporting framework 17 (only illustrated schematically in the figures). On an upper cross-beam 18 of the supporting framework 17 there is mounted a lifting member, which in the exemplary embodiment shown is a pressure-actuated cylinder 19. A cylinder 20 of the pressure-actuated cylinder 19 is connected fixedly to the cross-beam 18 and protrudes upwards with respect to the supporting framework 17. A piston rod 21 of the pressure-actuated cylinder 19 can be retracted and extended with respect to the cross-beam 18 along a perpendicular axis of movement 22. A gripping member, which in this case is a gripper 23, is fastened to the free, lower end of the piston rod 21. The length of the piston rod 21 is dimensioned such that when the piston rod is completely extended, the gripper 23 is lowered to such an extent in the supporting framework 17 that it can grasp preferably one item of laundry 11 at any desired point from the pile of laundry 10 in the funnel 13 (FIG. 1). In the retracted state of the pressure-actuated cylinder 19, the end of the piston rod 21 with the gripper 23 is situated slightly below the cross-beam 18, thus partially pulling the respective item of laundry 11 out of the pile of laundry 10 (FIG. 2).

A transfer means 24 is arranged between the funnel 13 and the cross-beam 18 of the supporting framework 17. In the exemplary embodiment shown, the transfer means 24 is situated at a distance below the gripper 23 raised to the maximum (FIGS. 2 and 3). In the case of the device shown here, the transfer means 24 is composed of a pivotable conveyor 25 and a pressure roller 26. The pivotable conveyor 25 is situated in a starting position in which it is pivoted into a vertical position on one side of the axis of movement 22 of the gripper 23. The pressure roller 26 is assigned to the opposite side of the axis of movement 22 (FIGS. 1 and 2). When the pivotable conveyor 25 is pivoted into an end position, it is situated along a horizontal line and intersects the axis of movement 22 approximately perpendicularly. At the same time, the positionally fixed pressure roller 26 bears, at a small distance from a return pulley 27, against the free end 28 of the pivotable conveyor 25 in order to form a narrow gap 29 between the pressure roller 26 and the return pulley 27 and, respectively, the top run 30 of the pivotable conveyor 25.

The pivotable conveyor 25 is a belt conveyor, the revolving conveyor belt of which is deflected around the return pulley 27 and around a driving pulley 31 lying opposite the return pulley. The return pulley 27 and the driving pulley 31 are mounted rotatably on a supporting structure (not illustrated). The driving pulley 31 is assigned a drive (not shown). A horizontal axis of rotation 32 of the driving pulley 31 is simultaneously the axis of rotation of the entire pivotable conveyor 25, and the pivotable conveyor 25 can hence be pivoted about the driving pulley 31 from the vertically directed starting position into the approximately horizontal final position. The conveyor 25 is pivoted using, preferably, a pressure-actuated cylinder (not shown) which is articulated at one end on the supporting framework 17 and at the other end on the supporting structure of the conveyor 25, approximately between the driving pulley 31 and the return pulley 27.

The positionally fixed pressure roller 26, which is arranged on that side of the axis of movement 22 of the gripper 23 which is opposite the pivotable conveyor 25, is preferably freely rotatable, i.e. does not have its own drive. The pressure roller 26 is caused to rotate if an item of laundry from the top run 30 of the conveyor belt, driven in a revolving manner, of the conveyor 25 is pulled through the gap 29 between the pressure roller 26 and the free end 28 of the pivotable conveyor 25.

The respectively separated item of laundry 11 is conveyed beyond the top run 30 by the pivotable conveyor 25 and on that side of the driving pulley 31 which is opposite the return pulley 27 in the region of the gap 29 is delivered onto a take-off conveyor 33. This take-off conveyor 33 is arranged below the pivotable conveyor 25 with a slight overlap, preferably such that a return pulley 34 of the take-off conveyor 33 lies approximately perpendicularly below the driving pulley 31 of the pivotable conveyor 25 (FIG. 3). The take-off conveyor 33 transports the separated items of laundry 10 away from the device to a feeding machine in front of a mangle, for example. Equally, the take-off conveyor 33 can transport the separated items of laundry 11 to another treatment device within the laundry.

The gripper 23 is assigned contactless signalling means (not shown). The signalling means detect whether an item of laundry 11 is suspended on the gripper 23. This detection takes place a short distance above the pile of laundry 10 in the funnel 13 and in that position of the gripper 23 where it is raised to the maximum. Moreover, the top run 30 of the pivotable conveyor 25 is assigned a signalling means which is preferably situated a short distance in front of the driving pulley 31. This signalling means indicates the extent to which the front edge of the respective item of laundry 11 is raised on the top run 30 of the pivotable conveyor 25. The pivoting position of the conveyor 25 can also be detected.

The method according to the invention is explained in more detail below with reference to the device illustrated in FIGS. 1 to 3:

A respective pile of laundry 10 is transferred by the feed conveyor 12 to the conveyor 14 and guided here by the funnel 13. The conveyor 14 transports the pile of laundry 10 into the end region 16 of the funnel 13. When this has been done, the pile of laundry 10 has reached a position which is specified for separating the items of laundry 11 and in which the conveyor 14 is stopped.

The items of laundry 11 are then removed, preferably individually, from the pile of laundry 10. For this purpose, the gripper 23 is lowered by the pressure-actuated cylinder 19 along the axis of movement 22 to such an extent that the gripper 23 can grasp preferably one item of laundry 11 at any desired point. The item of laundry 11 grasped in this manner is then partially pulled out of the pile of laundry 10, by retracting the pressure-actuated cylinder 19, the gripper 23 reaching its upper position below the cross-beam 18 of the supporting framework 17 (FIG. 2).

At this point, part of the item of laundry 11 is suspended in a perpendicular plane approximately along the axis of movement 22 of the gripper 23.

While part of the item of laundry 11 is being raised along the axis of movement 22, the pivotable conveyor 25 is completely pivoted downwards about its driving pulley 31 into its starting position, in which the top run 30 of the pivotable conveyor 25 is situated in an approximately perpendicular plane at a parallel distance from the axis of movement 22 (FIG. 2). Between the pivotable conveyor 25 and the pressure roller 26, on the other side of the item of laundry 11 raised along the axis of movement 22, there is formed a gap which is of maximum width in this starting position of the pivotable conveyor 25, and in which the raised part of the item of laundry 11 is not in contact either with the pivotable conveyor 25 or with the pressure roller 26.

In order for the transfer means 24 to take over the item of laundry 11, which is partially suspended below the gripper 23, the pivotable conveyor 25 is now pivoted about the axis of rotation 32 out of the perpendicular starting position. As soon as the return pulley 27 at the free end 28 of the pivotable conveyor 25 comes into contact with that part of the item of laundry 11 which is suspended along the axis of movement 22, the procedure of coupling up the item of laundry 11 to the transfer means 24 begins. In this procedure, the gap between the pivotable conveyor 25 and the pressure roller 26 is continuously reduced. During the further course of pivoting the conveyor 25 until it reaches its horizontal final position (FIG. 3), the narrow gap 29 is formed between the free ends 28 of the pivotable conveyor 25 and the pressure roller 26, the gap being dimensioned to allow through one item of laundry 10. The free end 28 of the pivotable conveyor 25 and the pressure roller 26 press from opposite sides against the item of laundry 11 in the gap 29.

The gripper 23 releases the item of laundry 11, which has been grasped at any desired point, if the item of laundry 11 is held reliably by the transfer means 24. This is preferably the case before the pivotable conveyor 25 is completely pivoted into its horizontal final position, i.e. at a time when the pressure roller 26 is not yet bearing against the item of laundry 11. That part of the item of laundry 11 which already has been pulled out of the pile of laundry 10 is then held by frictional resistance on the top run 30 of the pivotable conveyor 25. Should several items of laundry have been grasped and raised by the gripper 23, the opening of the gripper 23 before the conveyor 25 is completely pivoted up results in a frictional resistance only arising between a part of the item of laundry 11 which faces the pivotable conveyor 25, and the top run 30. This means that only a single item of laundry 11 is coupled up to the pivotable conveyor 25 while an item of laundry 11 raised simultaneously, or else further items of laundry 11 slide off the item of laundry 11 which rests on the top run 30 and is held there by frictional resistance. In this manner, reliable separating of only one item of laundry 11 is ensured. The pivotable conveyor 25 is subsequently completely pivoted into its horizontal final position, the pressure roller 26 coming to bear against the opposite side of the sole remaining item of laundry 11. The contact, by frictional resistance, of the top run 30 of the conveyor 25 and of the pressure roller 26 on the item of laundry 11, which is provided in this manner in the region of the gap 29 then makes it possible for the item of laundry 11 to be completely pulled out of the pile of laundry 10 when the conveyor 25 is driven (FIG. 3). When the conveyor 25 continues to be driven, the respective item of laundry 11 is guided by the conveyor 25 over its top run 30 and over that end of the driving pulley 31 of the conveyor 25 which is opposite the pressure roller 26, down to the take-off conveyor 33 and deposited there. This depositing preferably takes place with the take-off conveyor 33 at a standstill so that a respective item of laundry 11 is deposited on the take-off conveyor 33 in a pile. Subsequent, short-time driving of the take-off conveyor 33 allows the individual items of laundry 11 to lie thereon in a pile at a short distance one behind another (FIG. 3).

The abovementioned, contactless signal transmitters control the beginning and the end of the lifting movements of the gripper 23 and the start of pivoting of the pivotable conveyor 25. Signal transmitters also serve to open the gripper 23, in order to release the item of laundry 11, after the conveyor 25 has pivoted a certain distance. The drive of the conveyor 25 is also controlled as a function of its pivoting movement. It is conceivable only to start the drive of the pivotable conveyor 25 when the latter is pivoted into its horizontal final position. It is, however, furthermore also possible to drive the pivotable conveyor 25 continuously during the entire pivoting movement, or to only switch the drive on if the conveyor 25 has been pivoted about a certain angle, for example, has made contact with one side of the partially raised item of laundry 11.

It is also conceivable only to open the gripper 23 when the pivotable conveyor 25 is completely pivoted up into its horizontal final position and the pressure roller 26 has made contact with the opposite side of an item of laundry 11. If several items of laundry 11 have been grasped in this case, these can be detached from the item of laundry 11 to be separated by the pressure roller 26 being of driveable design, to be precise, such that it moves counter to the conveying direction of the pivatable conveyor 25 and in this manner moves a possible second or third item of laundry 11 out of the gap 29, and this item of laundry drops away over the free end 28 of the pivotable conveyor 25 back into the pile of laundry 10. In this case, transportation of all the items of laundry 11 out of the gap 29 by the pressure roller 26 is prevented by means of the greater frictional resistance of that lower item of laundry 11 which is resting at this time with a front edge region over virtually the entire length of the top run 30. It is thus ensured that the pressure roller 26, which is driven in the opposite direction to the conveyor 25, only transports back any excess item of laundry 11 and not that item of laundry 11, part of which is resting directly on the pivotable conveyor 25. As soon as complete separation of the item of laundry 11 is achieved in this manner, the drive of the pressure roller 26 is either stopped and the pressure roller 26 brought into a freewheeling position, or the driving direction of the pressure roller 26 is reversed such that it runs in the same direction as the drive of the pivotable conveyor 25.

Figure 4:
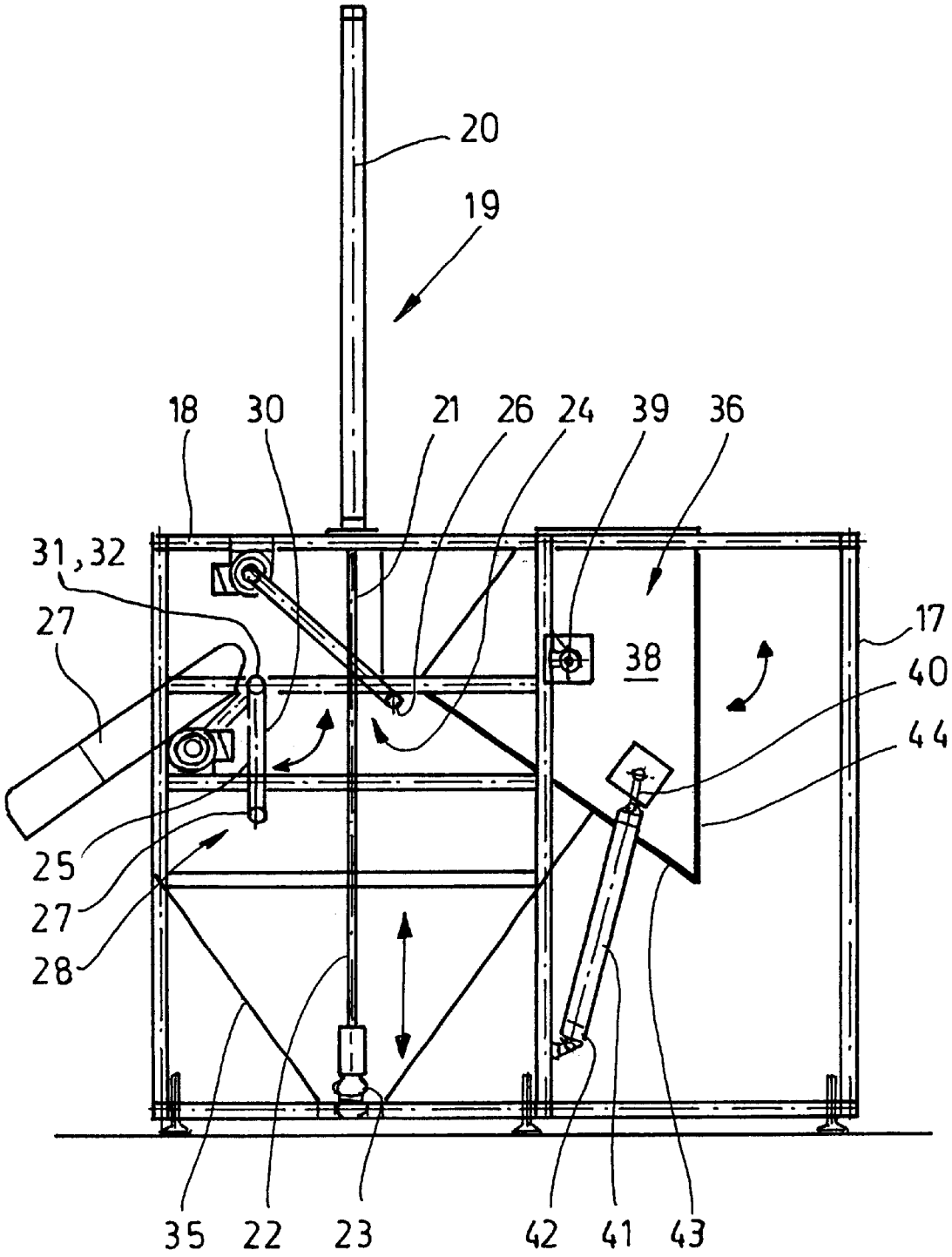
FIG. 4 shows a device according to a second exemplary embodiment of the invention with a temporary storage facility in a loading position.
Figure 5:
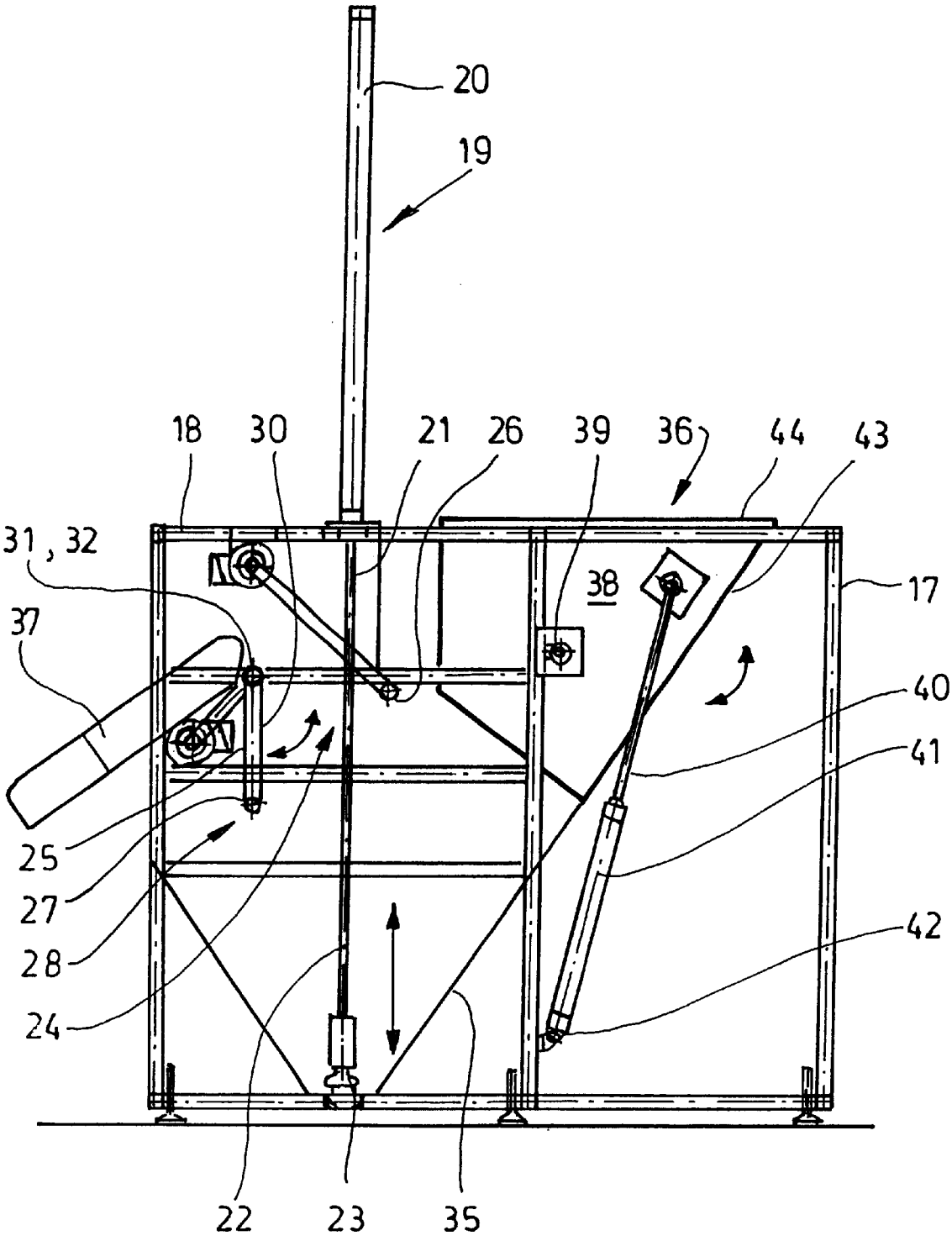
FIG. 5 shows the device of FIG. 4 with the temporary storage facility in an unloading position.

The device shown in FIGS. 4 and 5 differs from the device of FIGS. 1 to 3 essentially only in that the stockpiling means, which is designed as a funnel 35, is assigned a temporary storage facility 36, which is likewise essentially of funnel-like design. Otherwise, the device of FIGS. 4 to 5 corresponds to the device shown in FIGS. 1 to 3, identical parts or parts having identical functions having been provided with the same reference numbers. In particular, the device of FIGS. 4 to 5 also has a transfer means 24 comprising a pressure roller 26, which can be driven here in a rotating manner, and a pivotable conveyor 25 and also a gripper 23 which can be moved up and down by means of a pressure-actuated cylinder 19. In the device of FIGS. 4 and 5 an obliquely directed chute 37 is arranged upstream of the take-off conveyor 33 of FIGS. 1 to 3, via which chute the individual items of laundry pass from the pivotable conveyor 25 to the take-off conveyor (not shown in FIGS. 4 and 5).

The temporary storage facility 36 is arranged laterally above the funnel 35 below the gripper 23, to be precise such that it does not adversely affect the functioning of the gripper 23, which can be moved up and down by the pressure-actuated cylinder 19, and of the transfer means 24. The temporary storage facility 36 is mounted on the supporting framework 17 in a manner which allows it to pivot about a horizontal tilting axis. For this purpose, opposite side walls 38 of the temporary storage facility 36 are assigned bearings 39, which are connected to the supporting framework 17. The bearings 39, which form the tilting axis of the temporary storage facility 36, are situated approximately on a centre point of the surface of the respective side wall 38. As a result, the temporary storage facility 36 can be pivoted approximately about a horizontal longitudinal central axis.

An end, in particular a piston-rod end 40, of a pressure-actuated cylinder 41 is articulated on a lower, outer corner region of at least one side wall 38. An opposite piston end 42 of the pressure-actuated cylinder 41 is articulated on the supporting framework 17. Alternatively, it is also conceivable to assign a pressure-actuated cylinder 41 to each side wall 38. The temporary storage facility 36 is then pivoted by synchronously retracting and extending the two pressure-actuated cylinders 41.

When the pressure-actuated cylinder 41 is retracted the temporary storage facility 36 is in a loading position (FIG. 4). In this position, items of laundry can be conveyed from above into the temporary storage facility 36. When the pressure-actuated cylinder 41 is extended the temporary storage facility 36 is in an unloading position (FIG. 5). In this position, the items of laundry from the temporary storage facility 36 can pass automatically, that is to say directly, from the temporary storage facility 36 into the funnel 35. For this purpose, the temporary storage facility 36 is assigned to the funnel 35 in such a manner that it is situated laterally above the funnel 35.

The temporary storage facility 36 has two (planar) walls 43 and 44 extending between the parallel side walls 38. In FIGS. 4 and 5 these walls 43 and 44 are indicated by thick lines. In FIG. 4, in particular, it can be seen that the walls 43, 44 run towards one another at an angle of less than 90° and, as a result, are closed downwards in the loading position (FIG. 4). A side of the temporary storage facility 36 which lies opposite the walls 43, 44 is open. As a result, the temporary storage facility 36 can be filled in the loading position from above with items of laundry to be separated. In the unloading position shown in FIG. 5, the temporary storage facility 36 is pivoted through almost 90° about the tilting axis formed by the bearings 39 and, as a result, the wall 44, when horizontally directed, forms an upper side of the temporary storage facility 36 and the wall 43, which adjoins the wall 44, is an approximate extension of a wall (in FIGS. 4 and 5 the right-hand wall) of the funnel 35, i.e. is directed obliquely downwards. The open side of the temporary storage facility 36 is then pointing downwards enabling the items of laundry to automatically slide from the temporary storage facility 36 into the funnel 35. By being subsequently pivoted back into the position shown in FIG. 4, the temporary storage facility 36 is once again ready to receive new items of laundry.

Figure 6:
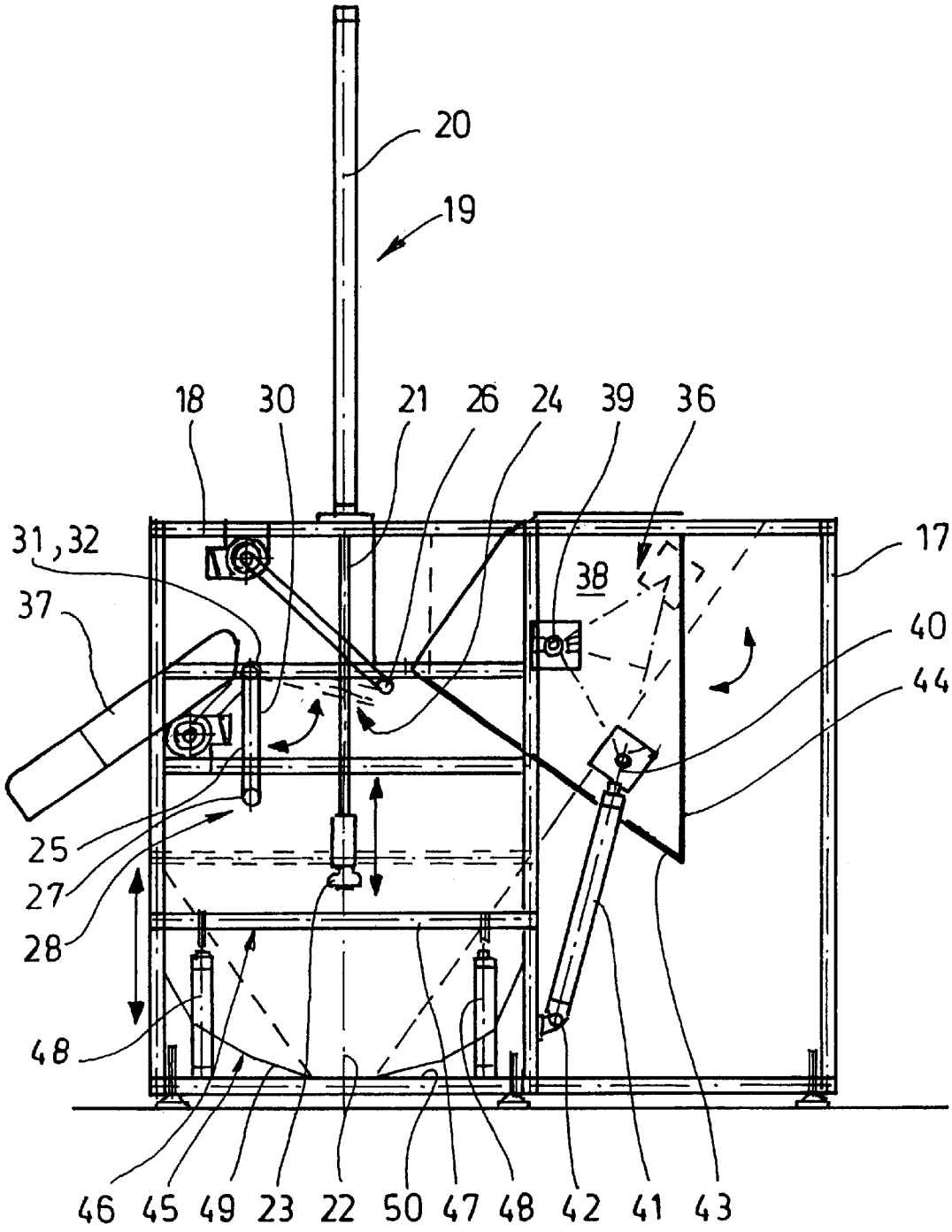
FIG. 6 shows a device according to a third exemplary embodiment of the invention.

FIG. 6 shows a device which only differs from the device of FIGS. 4 and 5 by the design of the stockpiling means below the gripper 23. The stockpiling means is designed here as a sack 45 which can be changed in shape. The sack 45 is made of a flexible material, for example a cloth. At least two opposite edges of a lip 46 running horizontally around the sack 45 are fastened to horizontal supporting bars 47. The supporting bars 47 are guided such that they can move up and down on the supporting framework 17, namely on perpendicular supports thereof. Furthermore, each supporting bar 47 is assigned two parallel, perpendicularly directed pressure-actuated cylinders 46. The pressure-actuated cylinders 46 are fastened at one end to the respective supporting bar 47 and at the other end to the lower end of the supporting framework 17. The pressure-actuated cylinders 48 are used to move each supporting bar 47, with the sack 45 suspended beneath them, up and down. The sack 45 is designed such that when the supporting bars 47 are completely lowered, i.e. when the pressure-actuated cylinders 48 are retracted, most of a base wall 49 of the sack rests on a horizontal support 50 on the lower side of the supporting framework 17. In this position which is illustrated in FIG. 6 by continuous lines the base wall 49 of the sack 45 is of relatively flat design which makes it possible for the sack 45 to receive the greatest possible quantity of items of laundry or the like.

If the sack 45 is moved up on the supporting bars 47 by means of the pressure-actuated cylinders 48 into the position which is dashed in FIG. 6, the base wall 49 of the sack 45 completely, or for the most part, loses contact with the support 50. The sack 45, which is of flexible design, in particular the base wall 49 thereof, thereby obtains a markedly funnel-like shape, the items of laundry, in particular remaining items of laundry, slipping to the deepest point of the sack 45. This deepest point of the sack 45 corresponds to the centre thereof. As a result, when the sack 45 is raised the items of laundry slipping to the deep centre thereof can be reliably grasped by the gripper 23 situated approximately centrally over it.

The slipping down of individual items of laundry into the deepest, lower point of the raised sack 45 can be assisted by the pressure-actuated cylinders 48 being extended jerkily or with interruptions. As a result, while the sack 45 is being raised, in which process it obtains an increasingly funnel-like shape, it is additionally agitated. The items of laundry can thereby reliably reach the deepest, central region of the base wall 49 of the sack 45.

It is also conceivable alternatively or additionally to assign to the sack 45, in particular the supporting bars 47, oscillation generators, for example unbalanced drives, which bring about a periodic agitating or oscillating of the sack 45.

Figure 7:
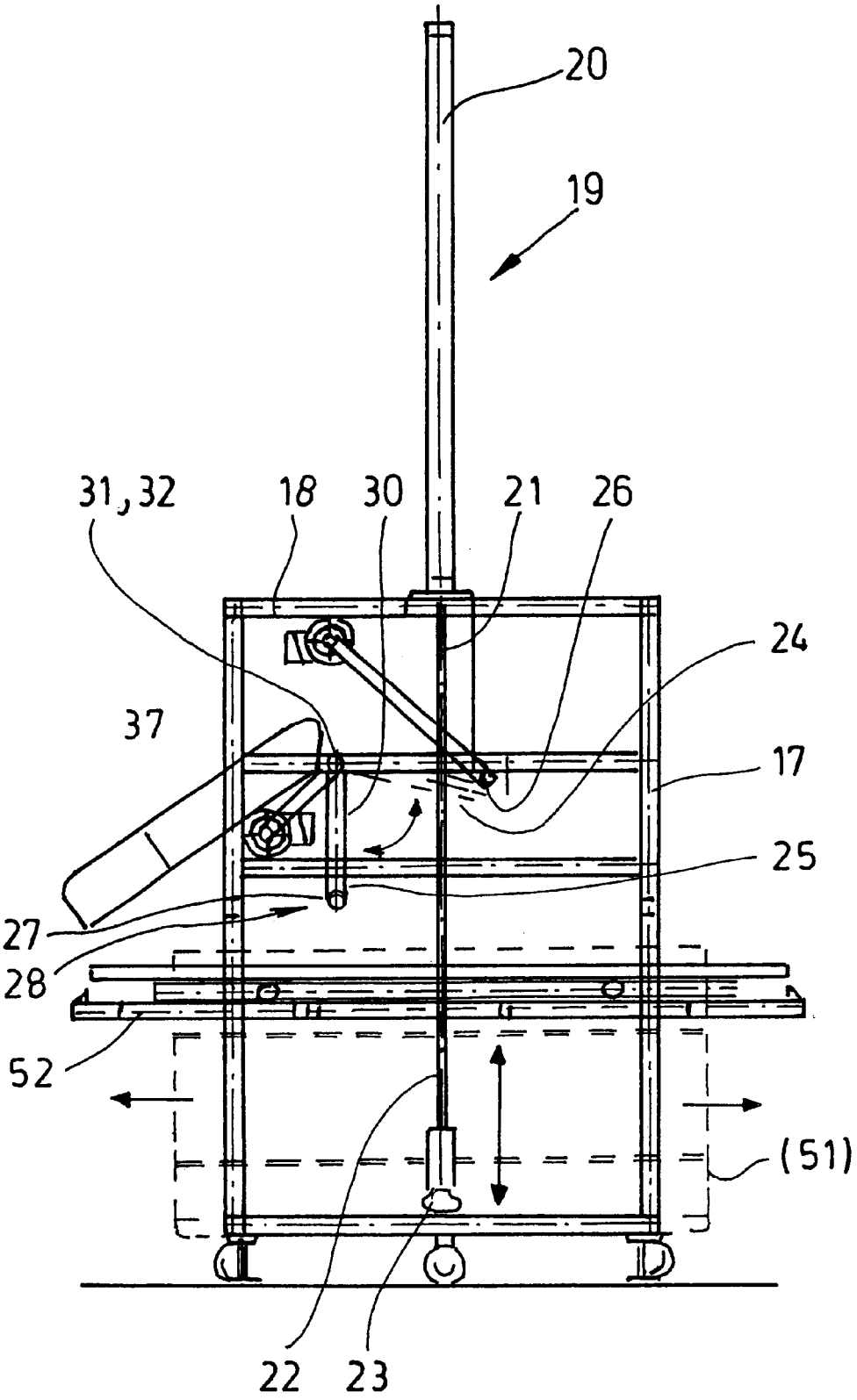
FIG. 7 shows a device according to a fourth exemplary embodiment of the invention.

FIG. 7 shows a device which differs from the device of FIGS. 1 to 3 by a funnel 13 (of FIGS. 1 to 3) being replaced by a container 51 which receives the items of laundry. The container 51 is suspended in a holding frame 52 which is fixedly arranged on the supporting framework 17. The holding frame 52 is designed such that it can move the container 51 to and fro in the horizontal direction, in accordance with the horizontal arrows in FIG. 7. The holding frame 52 moreover permits the container 51 to move up and down in the direction of the vertical double arrow in FIG. 7. The option of moving the container 51 both perpendicularly and horizontally under the gripper 23 makes it possible to move any point of the container 51 under the gripper 23 and, as a result, the latter can grasp even the last items of laundry in the container 51, and to be precise even those items of laundry which are situated in an outer corner of the container 51.

Figure 8:
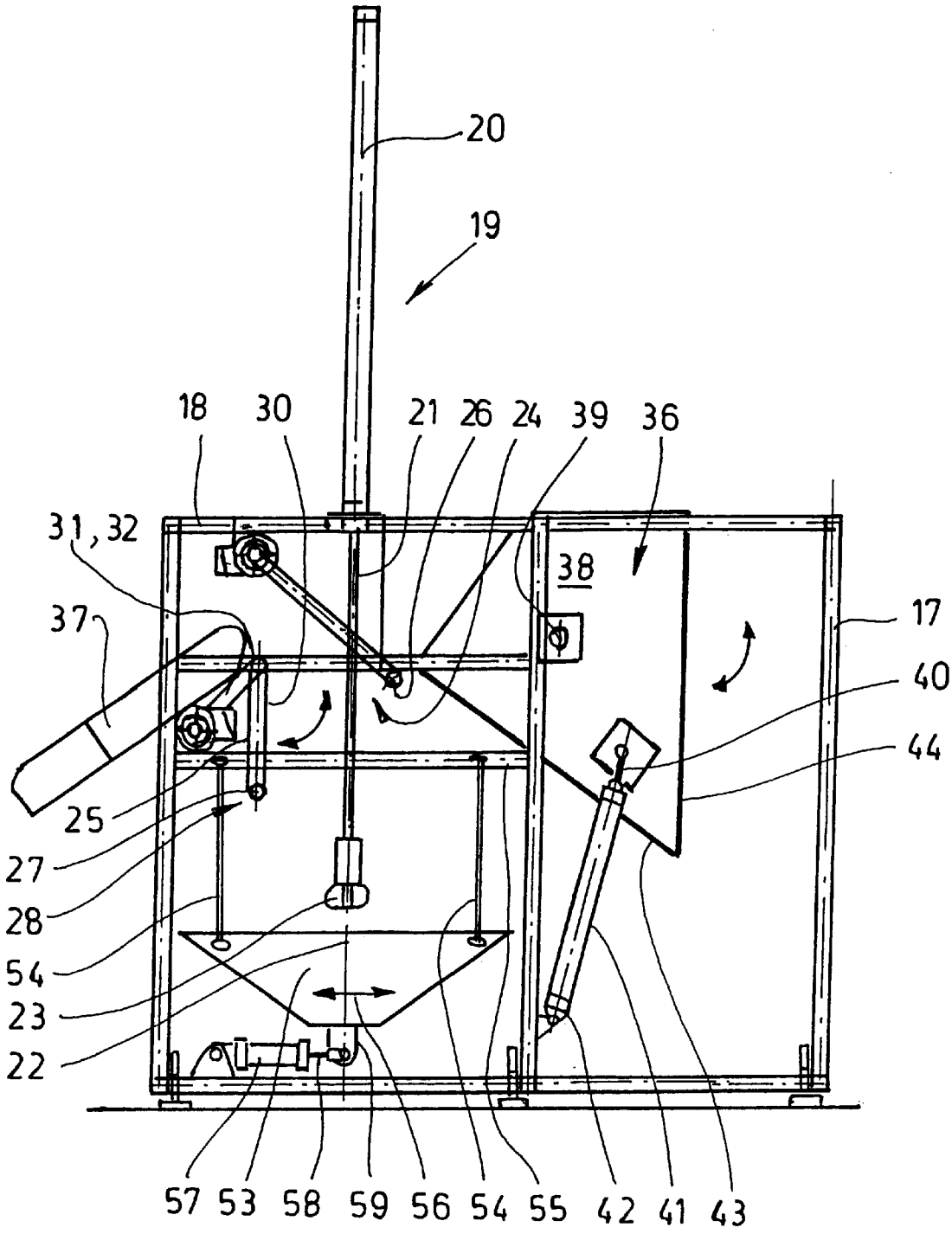
FIG. 8 shows a device according to a fifth exemplary embodiment of the invention.

FIG. 8 shows a device which essentially corresponds to the device in FIGS. 4 and 5. The same reference numbers are therefore used for identical parts. Deviating from the device in FIGS. 4 and 5, in the device of FIG. 8 the stockpiling means is designed as a shaking funnel 53.

The shaking funnel 53 is articulated on the supporting framework 17, namely on cross-beams 55 thereof, by means of just four link rods 54. The link rods 54, which are perpendicular in their non-displaced position, engage, in a manner which allows them to pivot freely, with their lower ends on the upper edge region of the shaking funnel 53 and with their upper ends on the cross-beams 55. The mounting of the shaking funnel 53 on the perpendicular link rods makes it possible for the shaking funnel 53 to be moved to and fro like a pendulum essentially in the horizontal direction, to be precise along an approximately horizontal path of movement which is indicated in FIG. 8 by the double arrow 56. In the exemplary embodiment shown, this path of movement runs transversely with respect to the axis of movement 22 of the gripper 23.

The shaking funnel 53 is moved by a linear drive, which in the exemplary embodiment shown is a pressure-actuated cylinder 57. The pressure-actuated cylinder 57 is preferably actuated by compressed air. This makes possible rapid, shock-like linear movements which cause periodic movements of the shaking funnel 53 along the path of the double arrow 56, as a result of which the items of laundry in the shaking funnel 53 are agitated or shaken in a jerky manner. The pressure-actuated cylinder 57 is fastened fixedly to the supporting framework 17 by one piston part. One end of a piston-rod 58 of the pressure-actuated cylinder 57 is hinged to a tab 59 below the shaking funnel 53. By retracting and extending the pressure-actuated cylinder 57, the shaking funnel 53 is moved to and fro, guided by the perpendicular link rods 54, along the path of movement indicated by the double arrow 56 transversely with respect to the axis of movement 22 of the gripper 23. In this manner, the shaking funnel 53 executes swinging movements with respect to the gripper 23, which movements, by appropriate driving of the pressure-actuated cylinder 57, can take place in a more or less jerky manner and, as a result, even the last items of laundry in the shaking funnel 53 slip to its deepest, central position and can thus reliably be removed from the shaking funnel 53 by the gripper 23.

The above detailed description of the preferred embodiments and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. Device which separates items of laundry, having a gripping device for grasping individual items of laundry from a pile of laundry, and having a transfer means for receiving the item of laundry from the gripping means and transporting the item of laundry downstream, characterized in that the transfer means (24) is formed from a endless conveyor (25) and a pressure member that cooperates with the conveyor (25), and the transfer means (24) has a non-contagious gap (29) through which an item of laundry (11) is transported.

2. Device according to claim 1, characterized in that the conveyor (25) is pivotable in design.

3. Device according to claim 1, characterized in that the gap (29) is of variable width and is formed between a part of the conveyor (25) and the pressure member.

4. Device according to claim 1, characterized in that the pressure member, is a freely rotatable pressure roller (26), is assigned to a first end of the pivotable conveyor (25) and is pivotable about a second opposite end of the conveyor (25).

5. Device according to claim 4, characterized in that the gripping device has an axis of movement, the pivotable conveyor (25) is arranged on one side of the axis of movement (22) of the gripping device, and the pressure roller (26) is situated on that side of the axis of movement (22) which is opposite the pivotable conveyor (25).

* * * * *